US005884540A

United States Patent [19]

Mo

[11] Patent Number: 5,884,540

[45] Date of Patent: Mar. 23, 1999

[54] TOOL HAVING REPLACEABLE JAWS

[76] Inventor: Yi Huang Mo, No. 7, Lane 74, Ton Hsin Road, Hsi Tun Chu, Taichung, Taiwan

[21] Appl. No.: 968,109

[22] Filed: Nov. 12, 1997

[51] Int. Cl.[6] ..... B25B 7/02

[52] U.S. Cl. ..... 81/423; 81/426

[58] Field of Search ..... 81/418, 421, 422, 81/423, 424, 424.5, 426, 426.5

[56] References Cited

U.S. PATENT DOCUMENTS

| | | | |
|---|---|---|---|
| 580,429 | 4/1897 | Snyder | 81/422 |
| 2,818,755 | 1/1958 | Kahn | 81/422 |
| 3,171,132 | 3/1965 | Dritz | 81/423 |
| 3,176,551 | 4/1965 | Hansen | 81/423 |
| 3,383,963 | 5/1968 | Vondrachek | 81/423 |
| 4,353,240 | 10/1982 | Undin et al. | 81/421 |
| 4,813,310 | 3/1989 | Moynihan | 81/423 |
| 4,926,685 | 5/1990 | Shannon, Sr. | 81/422 |
| 5,079,977 | 1/1992 | Petrie | 81/423 |
| 5,285,703 | 2/1994 | Carson | 81/423 |
| 5,579,667 | 12/1996 | Kim | 81/423 |

*Primary Examiner*—David A. Scherbel
*Assistant Examiner*—Joni B. Danganan

[57] ABSTRACT

A tool includes a pair of levers having a middle portion pivotally coupled together and having a handle formed on one end and a bar formed on the other end. The bars each have a cavity. A pair of jaws each has a stud for engaging with the cavity of the bar and for allowing the jaws to be secured to and disengaged from the bars. One of the jaws includes a jut or a pin or a protrusion for engaging with the recess or the cavity or the aperture of the other jaw and for forming various kinds of pliers. The jaws each includes a knurled surface for forming a pair of pliers.

4 Claims, 4 Drawing Sheets

TOOL HAVING REPLACEABLE JAWS

BACKGROUND OF THE INVENTION

1. Field of the Invention

The present invention relates to a tool, and more particularly to a plier-type tool having replaceable jaws.

2. Description of the Prior Art

Typical plier-type tools, such as pliers, crimping tools, ear tag clamping tools, retaining ring fitting tools, each includes a pair of levers having a handle formed in one end and a jaw formed in the other end. The jaws are solidly secured or provided on the handle and may not be disengaged from the handle for replacing the other tools. The users thus have to buy a number of tools each for a particular use.

The present invention has arisen to mitigate and/or obviate the afore-described disadvantages of the conventional tools.

SUMMARY OF THE INVENTION

The primary objective of the present invention is to provide a plier-type tool which includes one or more pairs of jaws that may be secured and disengaged from the handles for adjusting to different uses.

In accordance with one aspect of the invention, there is provided a tool comprising a pair of levers including a middle portion pivotally coupled together at a shaft, the levers each including a lower portion having a handle and each including an upper portion having a bar, the bars each including a cavity, and a pair of jaws each including a stud for engaging with the cavity of the bars and for allowing the jaws to be secured to and disengaged from the bars.

The studs each include a securing means for securing the stud to the bar. The securing means includes a spring-biased projection engaged in the stud for engaging with the bar and for securing the stud to the bar.

The bars each include a recess formed above the cavity for forming a stepped hole, the jaws each include a protrusions extended downward for engaging with the recess of the bar, the studs are extended downward from the protrusions for engaging with the cavities of the bars.

The jaws each include a knurled surface for allowing the jaws and the bars to form a pair of pliers. One of the jaws includes a recess or a cavity, the other jaw includes a jut or a protrusion for engaging with the recess or the cavity. One of the jaws includes an aperture, the other jaw includes a rotary member rotatably secured in the second jaw and having one or more pins extended radially outward for engaging with the aperture and for punching a hole in an object.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
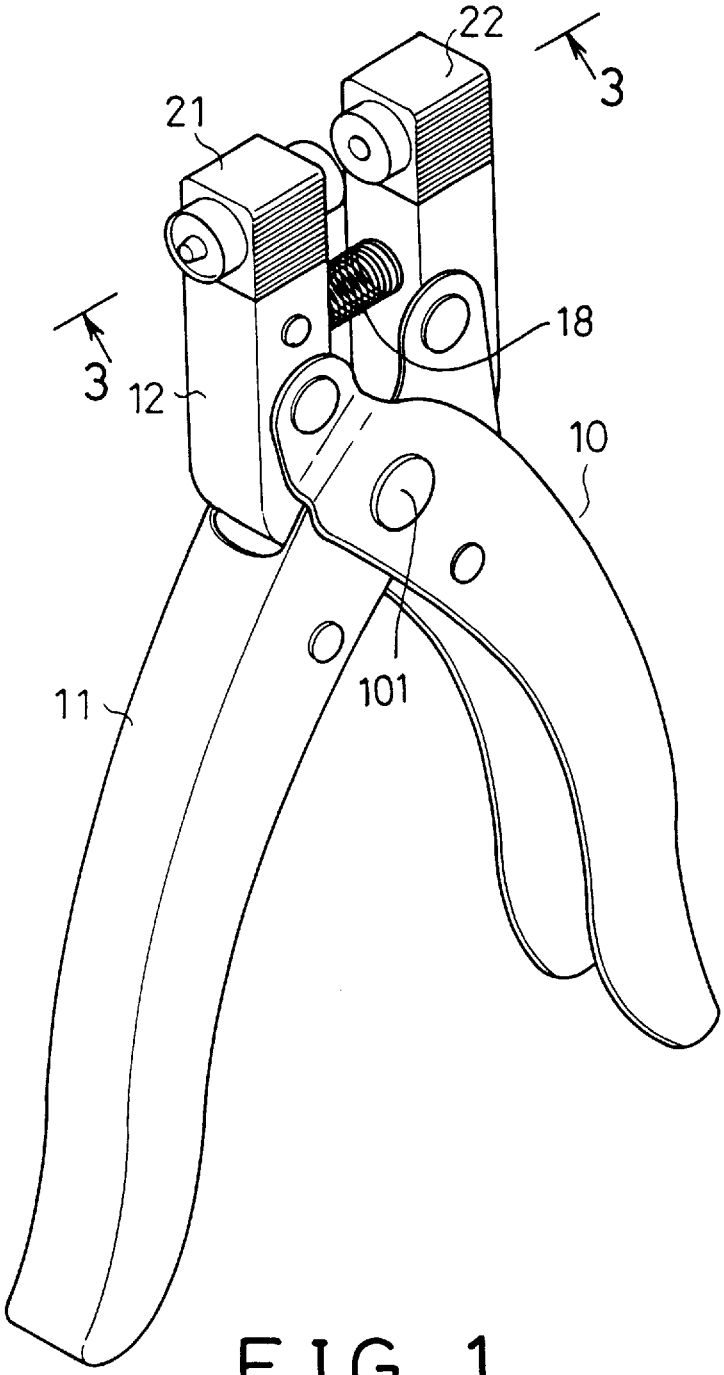
FIG. 1 is a perspective view of a plier-type tool in accordance with the present invention.
Figure 2:
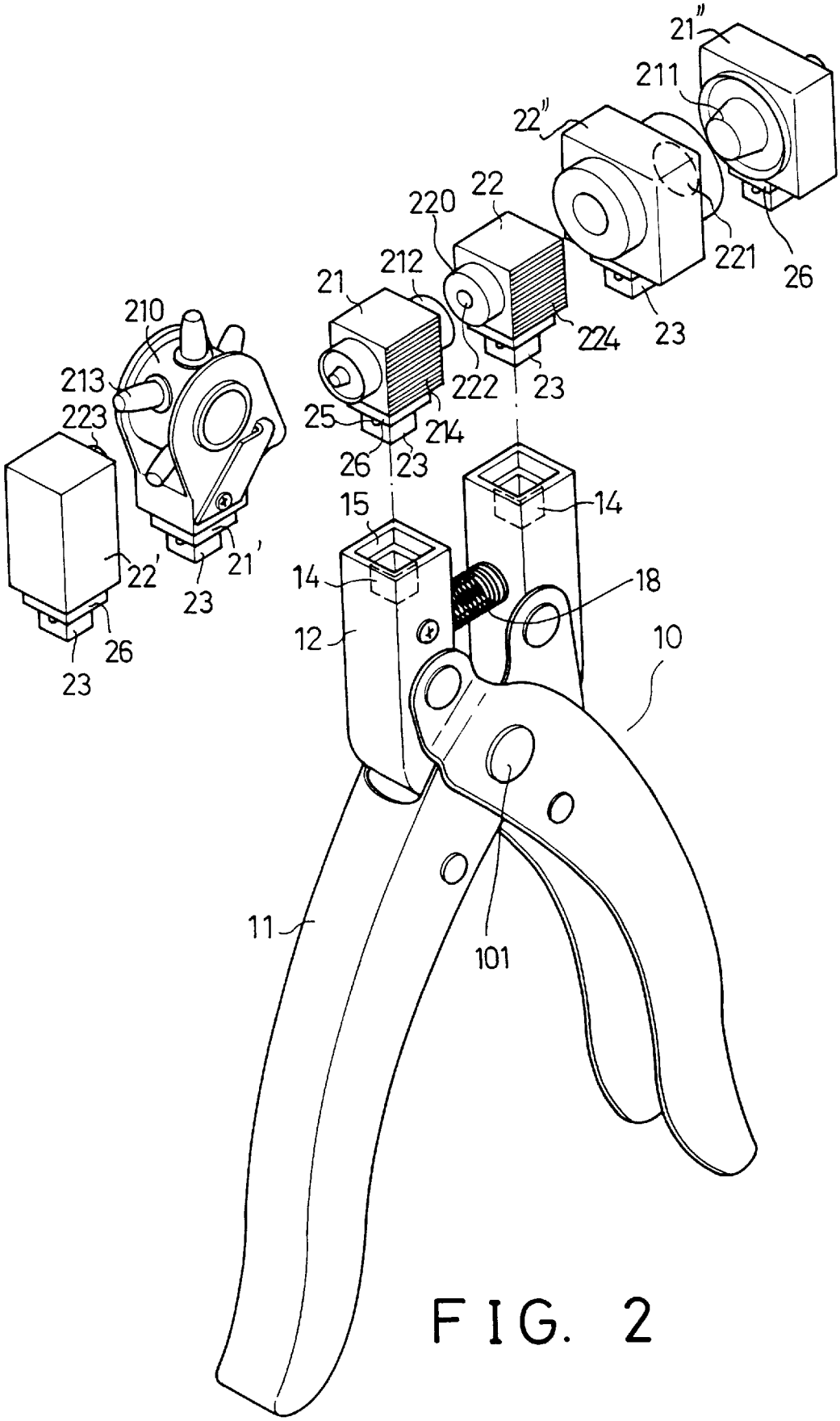
FIG. 2 is an exploded view of the tool.
Figure 3:
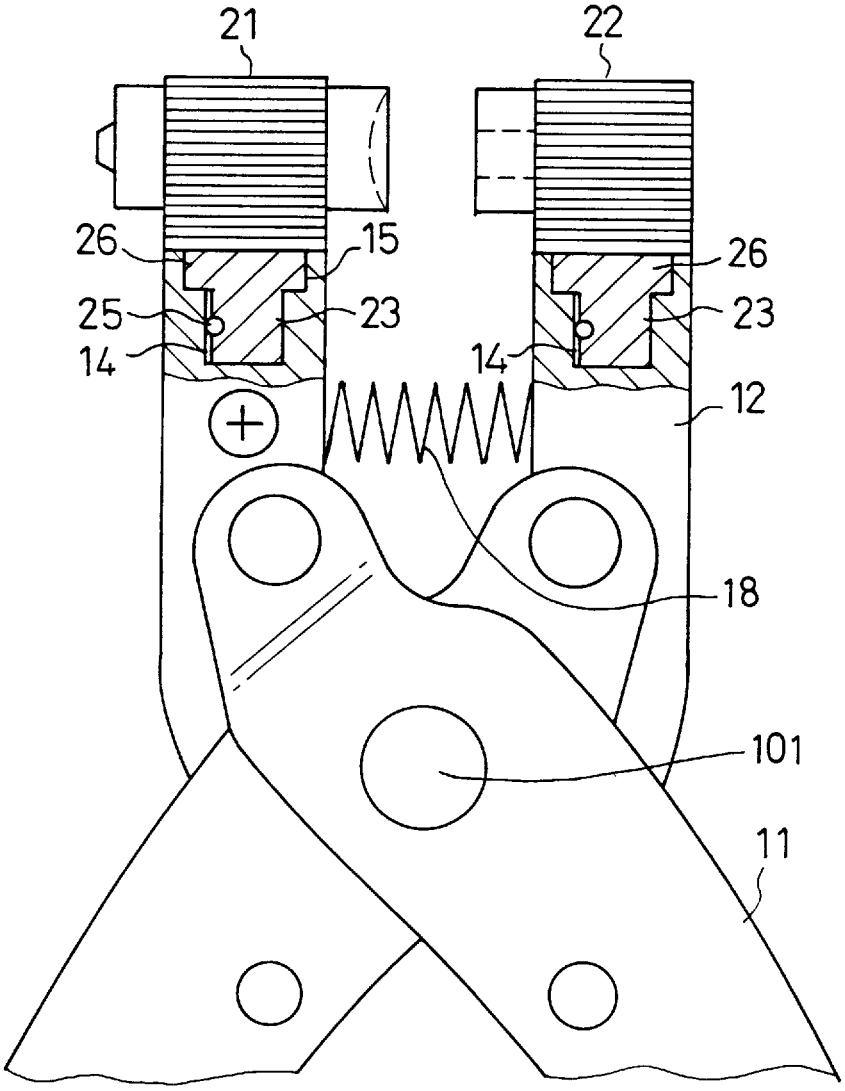
FIG. 3 is a partial cross sectional view taken along lines 3—3 of FIG. 1.

Referring to the drawings, and initially to FIGS. 1–3, a tool in accordance with the present invention is a plier-type tool and comprises a pair of levers 10 pivotally coupled together at a shaft 101 and each including a handle 11 formed on one end and a bar 12 formed on the other end. A spring 18 is engaged between the bars 12 or between the handles 11 for biasing the bars 12 away from each other. The bars 12 each include an upper portion having a cavity 14 and a recess 15 for forming a stepped hole. It is preferable that the recess 15 includes a size greater than that of the cavity 14.

One or more pairs of jaws 21, 22, 21', 22', 22", 22", 21'", 22'" of different type tools may be easily secured to the bars 12 and may be easily replaced one from the other according to the user's need. The jaws 21, 22, 21', 22', 22", 22", 21'", 22'", each include a protrusion 26 and a stud 23 extended downward for engaging with the recess 15 and the cavity 14 respectively and for allowing the jaws 21, 22, 21', 22', 22", 22", 21'", 22'", to be solidly secured to the bars 12. It is preferable that the protrusion 26 includes a size greater than that of the stud 23 for allowing the protrusion 26 and the stud 23 to be snugly engaged in the respective recess 15 and cavity 14. The studs 23 each include a spring-biased projection 25 for engaging with the bar 12 and for further solidly securing the jaws 21, 22, 21', 22', 22", 22", 21'", 22'", to the bars 12.

Figures 4, 5, 6, 7, 8:
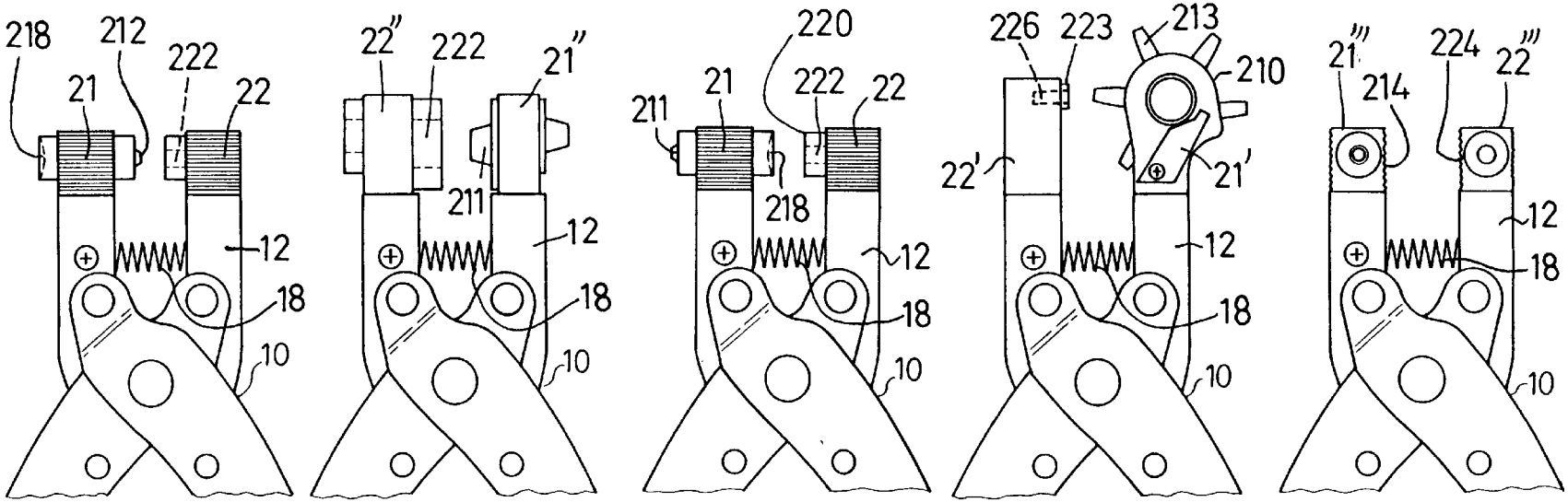
FIGS. 4, 5, 6, 7, 8 are partial plan views illustrating the applications of the tool.

Referring next to FIG. 4 and again to FIGS. 1 and 2, the jaw 22 includes a cavity 222 and the jaw 21 includes a protrusion 212 for engaging with the cavity 222. The engagement of the protrusion 212 and the cavity 222 may be used for forming or for securing a grommet to a cloth and the like. As shown in FIGS. 1 and 5, the jaw 21" may include a jut 211 and the other jaw 22" may also include a cavity 222 for engaging with the jut 211 and for allowing the jaws 21", 22" to be formed as a clamping tool or a crimping tool. As shown in FIG. 6, the jaw 22 includes a swelling 220 for engaging with a depression 218 of the other jaw 21 and for allowing the jaws to form a clamping tool. As shown in FIG. 7, the jaw 22 includes a block 223 having an aperture 226, and the other jaw 21' includes a rotary member 210 rotatably secured in the jaw 21'. The rotary member 210 includes a number of pins 213 extended radially outward for engaging with the aperture 226 and for punching holes in objects. As shown in FIG. 8, the jaws 21'", 22'" may each include a knurled surface 214, 224 for allowing the tool to be formed as a pair of typical pliers.

Accordingly, the tool in accordance with the present invention includes one or more pairs of jaws of different types of tools that may be easily secured to and disengaged from the handles such that the tool may be used for conducting various kinds of works.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a pair of levers including a middle portion pivotally coupled together at a shaft, said levers each including a lower portion having a handle and each including an upper portion having a bar, said bars each including a cavity, and a pair of jaws each including a stud for engaging with said cavity of said bars and for allowing said jaws to be secured to and disengaged from said bars, a first of said jaws including an aperture, a second of said jaws including a rotary member rotatable secured in said second jaw, said rotary member including at least one pin extended radially outward for engaging with said aperture and for punching a hole in an object.

2. The tool according to claim 1, wherein said studs each include a securing means for securing said stud to said bar.

3. The tool according to claim 2, wherein said securing means includes a spring-biased projection engaged in said stud for engaging with said bar and for securing said stud to said bar.

4. The tool according to claim 1, wherein said bars each include a recess formed above said cavity for forming a stepped hole, said jaws each include a protrusion extended downward for engaging with said recess of said bar, said studs are extended downward from said protrusions for engaging with said cavities of said bars.

* * * * *